US005581294A

United States Patent [19]

Fujii et al.

[11] Patent Number: 5,581,294

[45] Date of Patent: Dec. 3, 1996

[54] SERIAL THERMAL PRINTING METHOD

[75] Inventors: Masatsugu Fujii; Hiroyuki Iwasaki, both of Saitama, Japan

[73] Assignee: Fuji Photo Film Co., Ltd., Kanagawa, Japan

[21] Appl. No.: 317,370

[22] Filed: Oct. 4, 1994

[30] Foreign Application Priority Data

Oct. 6, 1993 [JP] Japan ..... 5-250532

[51] Int. Cl.[6] ..... B41J 2/36

[52] U.S. Cl. ..... 347/183; 347/186

[58] Field of Search ..... 347/183, 184, 347/185, 186; 400/120.07, 120.08; 358/298

[56] References Cited

U.S. PATENT DOCUMENTS 4,760,462 7/1988 Ogawa ..... 347/186
5,363,125 11/1994 Inui et al. ..... 347/183
5,382,965 1/1995 Yamakawa et al. ..... 347/183

FOREIGN PATENT DOCUMENTS 5-155058 6/1993 Japan .

*Primary Examiner*—Huan H. Tran

[57] ABSTRACT

A thermal head has a plurality of heating elements disposed in line. These heating elements are grouped into sets of four heating elements. Each set records one pixel which is constituted by 4×8 cells disposed in a matrix shape. Each cell is selectively recorded with an ink micro dot. A blank section record an nth pixel, and immediately before each heating element faces the first main micro line of an (n+1)th pixel. In the course of this blank section, each time the thermal head moves by a predetermined distance, each heating element is driven by drive data which does not make the heating element turn on. In a preferred embodiment, if an nth pixel has a low density, each heating element is selectively driven to the extent that an ink micro dot is not recorded, so as to preheat the selected heating element in the course of the blank section.

18 Claims, 9 Drawing Sheets

SERIAL THERMAL PRINTING METHOD

BACKGROUND OF THE INVENTION

1. Field of the Invention

The present invention relates to a serial thermal printing method suitable for recording a half tone image.

2. Description of the Related Art

There are generally two thermal recording methods, including direct thermal printing (thermal recording) for directly recording an image on a recording paper and thermal transfer printing (thermal transfer recording) for transferring ink from an ink film to a recording paper. The thermal transfer recording has a thermal wax transfer type (melting type) for transferring melted ink to a recording paper and a thermal dye transfer type (sublimation type) which changes an ink amount transferred to a recording paper in accordance with a heat energy. For the thermal transfer recording, for example, a serial thermal printer is widely used in which a thermal head is moved in a subsidiary scan direction to record through one line and then the recording sheet is fed by one line in a main scan direction, in order to reduce the size and weight of the printer.

A thermal printing method using an area gradation method of recording a half tone by changing the area of ink dots in one pixel is known as described in, for example, Japanese Patent Laid-open Publication 5-155058. With this thermal printing method, one pixel is constituted by a plurality of main micro lines arranged in the main scan direction, and heating elements are selectively driven each time the thermal head is moved by one main micro line. One heating element selectively records an ink micro dot in one pixel at each main micro line. One ink dot is constituted by a plurality of micro dots. By changing the number of driving times of a heating element in accordance with image data representative of a tonal level, it is possible to change the area of micro dots in one pixel.

With the above-described thermal printing method, in recording of the first main micro line of the (n+1)th pixel after recording of the nth pixel, part of each heating element is positioned at a plurality of main micro lines which are the closing of the nth pixel. If the nth pixel is low in density and its closing main micro lines have no recording of micro dots, the density of the nth pixel is changed to middle by the recording of the (n+1)th pixel, because micro dots are recorded on these main micro lines. There is therefore a problem of a poor representation of gradation at a low density. If an applied voltage or conduction time of each heating element is changed to solve this problem, the gradation representation becomes poor at a high density.

SUMMARY OF THE INVENTION

It is a principal object of the present invention to provide a serial thermal printing method capable of providing a good gradation representation.

It is another object of the present invention to provide a serial thermal printing method simple in driving a thermal head.

In order to achieve the above objects, the invention provides a serial thermal printing method. One pixel is constituted by N subsidiary micro lines to be recorded by a set of N adjacent heating elements and by M main micro lines extending in the main scan direction partitioned by each movement of a thermal head in the subsidiary scan direction. The width of the first main micro line of the M main micro lines is equal to the length B of the heating element in the subsidiary scan direction, and the width of each of the second to Mth main micro lines is L. The length B may be any value, but can preferably be an integer multiple of the width L. Each heating element is driven by M drive data to sequentially record ink micro dots from the first main micro line to the Mth main micro line. The thermal head is moved in an idle state after recording the Mth main micro line at the end of an nth pixel and immediately before the first main micro line of an (n+1)th pixel.

The section where the thermal head is moved in the idle state is a blank section. In the course of the blank section, each time each heating element moves by the width L, the heating element is driven by predetermined virtual drive data which does not record an ink micro dot. The heating element may be driven by drive data which does not power the heating element.

In a preferred embodiment of the invention, each heating element is selectively driven and preheated in accordance with the record state of an nth pixel, after recording the Mth main micro line of the nth pixel and before recording the first main micro line of an (n+1)th pixel. For example, if the nth pixel has a low density, each heating element is heated only at the initial stage of recording and thereafter enters a cooling period. Therefore, in some cases, the heating element is cooled too much. If the first main micro line of the (n+1)th pixel is recorded in such a case, only central heating elements having a high temperature can record ink micro dots. In view of this, each heating element is driven in course of the blank section in accordance with its heating history. In practice, each heating element is selectively driven and preheated to the extent that micro dots are not recorded, by taking the image data of the nth pixel into consideration. In this manner, since each heating element is driven in the course of the blank section to the extent that micro dots are not recorded, by taking the record state of a preceding pixel, i.e., the drive state of this pixel, into consideration, it is possible to prevent the heating element from being cooled too much. It is therefore possible to record a pattern of ink micro dots having a suitable size on the first main micro line.

According to the present invention, a set of a plurality of heating elements is used for recording one pixel, and the number of fine subsidiary ink dots is increased as the tonal level becomes high, being able to obtain a sufficient gradation representation. In recording the first main micro line of the (n+1)th pixel after the nth pixel, the thermal head is moved in an idle state to the position where the heating element separates from the main micro line at the end of the nth pixel, thereby preventing a pixel from having a high density and improving the degradation representation. During the idle motion state, each heating element is driven by virtual drive data at a predetermined pitch so that a special sequence control for the idle motion of the thermal head is not necessary.

These and other objects of the present application will become more readily apparent from the detailed description given hereinafter. However, it should be understood that the preferred embodiments of the invention are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the detailed description of the preferred embodiments when read in conjunction with the accompanying drawings, in which.

DETAILED DESCRIPTION OF THE PREFERRED EMBODIMENTS

Figure 1:
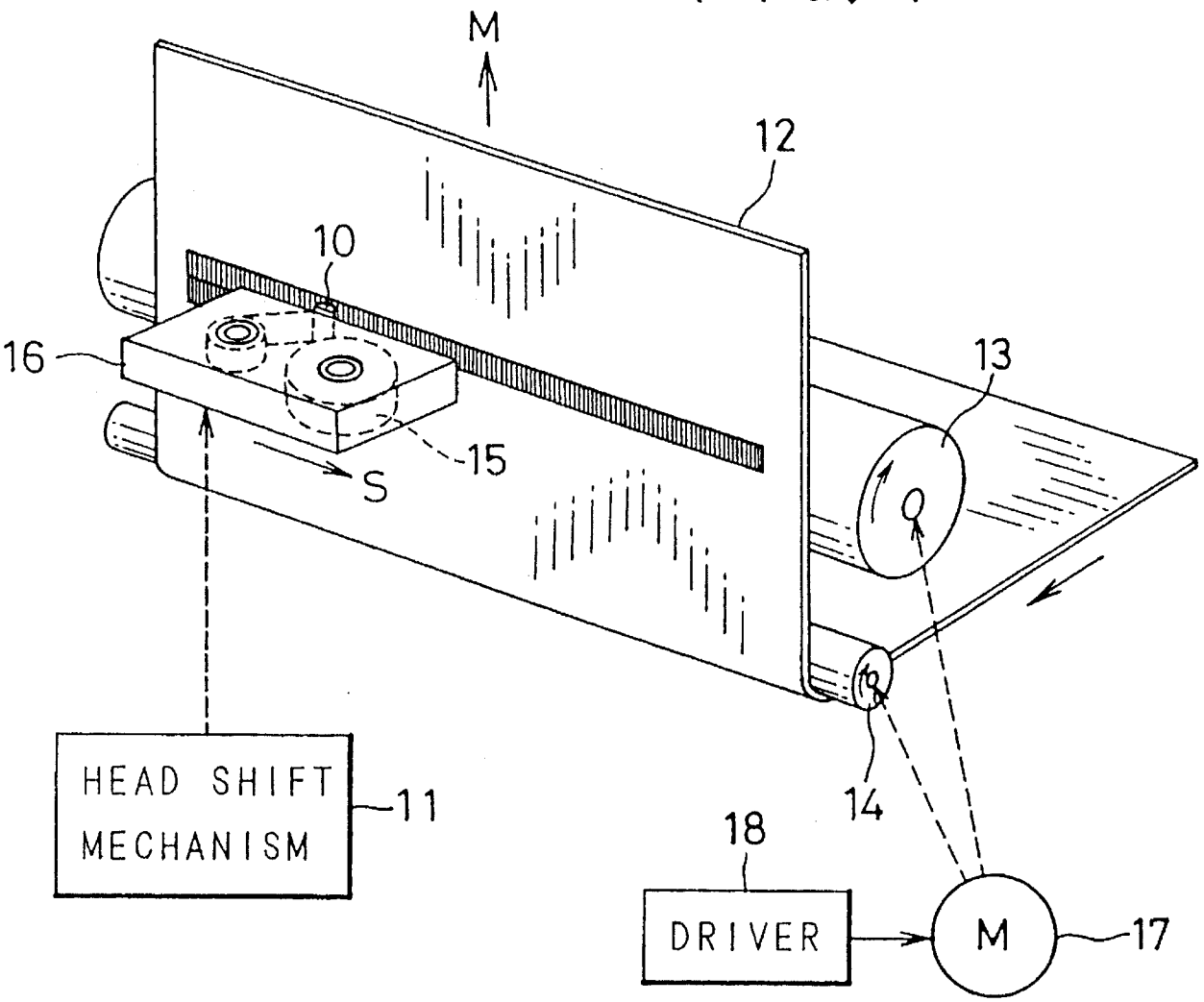
FIG. 1 is a schematic diagram showing an example of a serial thermal printer embodying the present invention.

Referring to FIG. 1 showing a serial printer of a thermal wax transfer type embodying this invention, a thermal head 10 is reciprocally moved in the subsidiary scan direction S by a head shift mechanism 11, and a recording paper 12 is fed by one line at a time in the main scan direction M by a platen roller 13 and a feed roller 14. A ribbon cassette 16 is mounted on a head carriage (not shown) at the back of the thermal head 10. The ink ribbon 15 is pulled out shortly from the ribbon cassette 16 and inserted between the thermal head 10 and the recording paper 12. Reference numeral 17 represents a pulse motor for driving the platen roller 13 and feed roller 14, and reference numeral 18 represents a motor driver.

In the recording operation, the ink ribbon 15 is pushed by the thermal head 10 from the back of the ink ribbon 15 and made to be in tight contact with the recording paper (image receiving paper) 12. Further, the ribbon cassette 16 together with the thermal head 10 is moved in the subsidiary scan direction S by the head shift mechanism 11. The thermal head 10 heats the back of the ink ribbon 15 to transfer melted or softened ink to the recording paper 12. After the recording of one line, the thermal head 10 and ribbon cassette 16 are returned to the initial position, and the recording paper 12 is fed by one line in the main scan direction M. In this case, if a paper feed is irregular, a gap is formed between two lines and an unrecorded blank line is formed. In order to avoid this, a paper feed may be performed to overlap two lines slightly.

Figure 2:
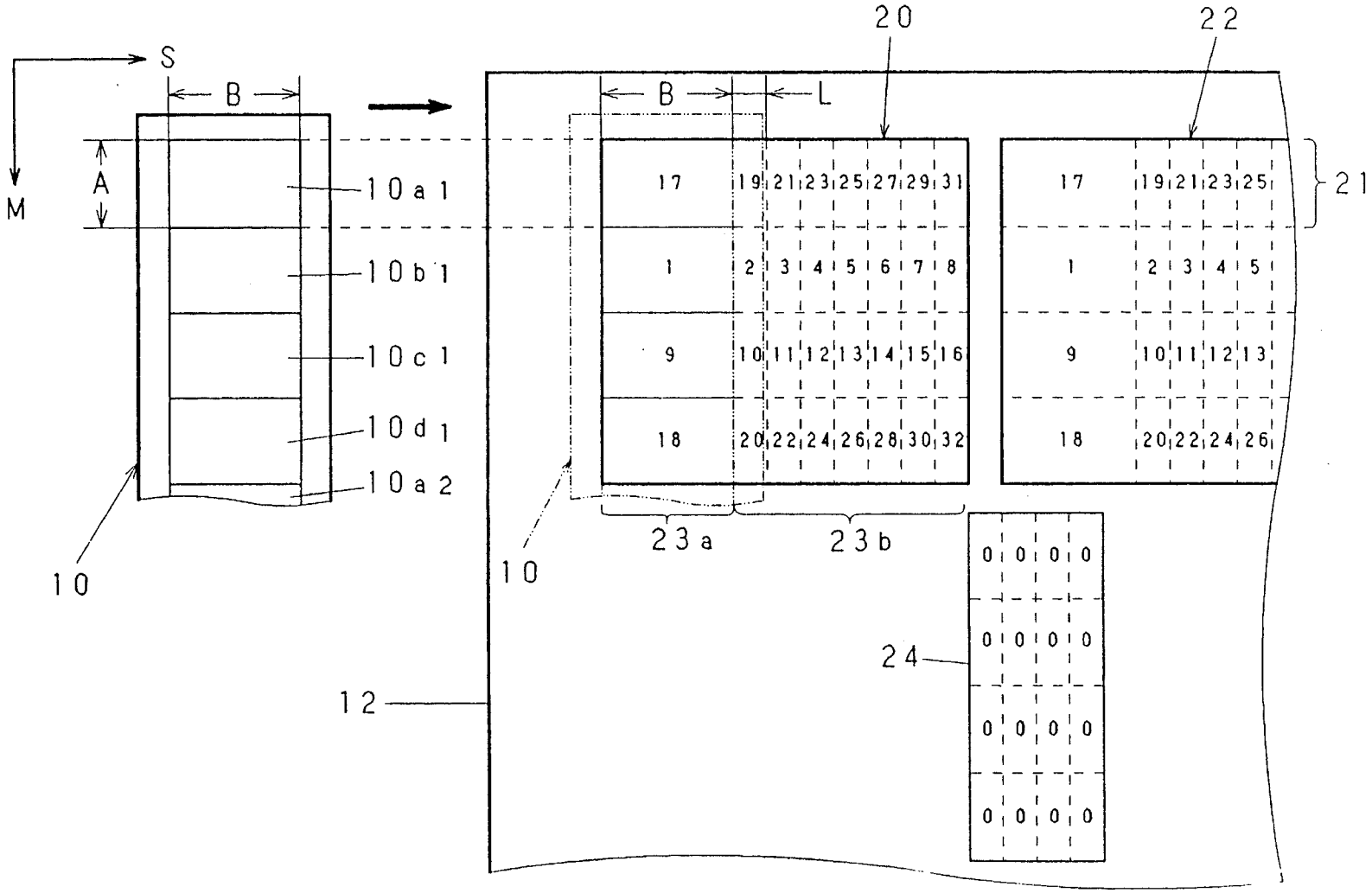
FIG. 2 is a diagram explaining the order of recording ink micro dots in a pixel and an example of virtual drive data.

Referring to FIG. 2, the thermal head 10 has, for example, 144 heating elements 10*a*1, 10*b*1, 10*c*1, 10*d*1, 10*a*2, . . . disposed in line in the main scan direction M. Each heating element is rectangular and has a length A in the main scan direction M and a length B in the subsidiary scan direction S. For example, A is about 70 μm and B is about 110 μm. Each heating element records a subsidiary micro line 21 having a width A and extending in the subsidiary scan direction S. As the thermal head 10 moves reciprocally once, one hundred and forty four subsidiary micro lines 21 are recorded. The temperature distribution of each heating element is not uniform in the subsidiary scan direction S. In some cases, the temperatures at opposite ends of a heating element are so low that ink cannot be transferred through them. Used as a substitute for such a heating element is a heating element having the length B in the main scan direction longer than 110 μm.

In this embodiment, the heating elements are grouped into sets of four heating elements. Each set of four heating elements records one pixel. As a result, with 144 heating elements, 36 pixels are recorded at a time. Each pixel is constituted by four subsidiary micro lines 21 and eight main micro lines, i.e., by 4×8 cells disposed in a matrix shape. Each pixel is generally a square. The width of the first main micro line 23*a* is the same as the length B of a heating element in the subsidiary scan direction S, and corresponds to four feed steps of the thermal head 10. The width of each of the second to eighth main micro lines 23*b* is equal to one feed step amount L of the thermal head 10. In the present embodiment, B=4L. B is determined as an integral multiple of L for simplicity of movement of the thermal head 10. Instead, it is possible to determine B irrespective of L as desired.

For example, in recording a pixel 20, after the first main micro line 23*a* is recorded, the thermal head 10 is intermittently fed by the distance L. The heating elements 10*a*1 to 10*d*1 are driven by the drive data generated in association with image data. After the pixel 20 is recorded, the thermal head 10 is fed by five steps. At this time, the heating elements confront the first main micro line 23*a* of the next pixel 22, and recording of the pixel 22 by drive data starts. Only the last one step is effective, and the first to fourth steps are idle.

These four steps form a blank section not associated with recording. In the course of this blank section, the heating elements 10*a*1 to 10*d*1 are driven by virtual drive data which is short of allowing transfer of ink. The virtual drive data is indicated by reference numeral 24. In this embodiment, all heating elements are supplied with "0" so that they are not powered in course of the blank section, and the thermal head 10 is cooled naturally or forcibly by cool air. The number in each cell of the pixels 20 and 22 indicates the tonal level.

This embodiment uses the blank section of four steps. Ideally, the blank section can be constituted by three steps, and three virtual drive data values can be used for each heating element. However, if the number of heating events is large in one pixel, a smeared image is recorded because of heat accumulation of the heating element. A smeared image is recorded with ink transferred to the recording paper 12 although the heating element is not driven. In this embodiment, therefore, the blank section is made of four steps, each heating element is supplied with four virtual drive data, and one main micro line having the width L is located between adjacent pixels. With this arrangement, in recording an ink dot pattern developing in the subsidiary scan direction S, ink micro dots are recorded on the first main micro line (forming the space between two pixels) in the blank section irrespective of drive data of "0", because of the influence of heat generated by recording micro dots on the last main micro line of the preceding pixel. Accordingly, pixel continuity can be maintained at the high density range, and the middle/low density is prevented from being raised.

Figure 3A:
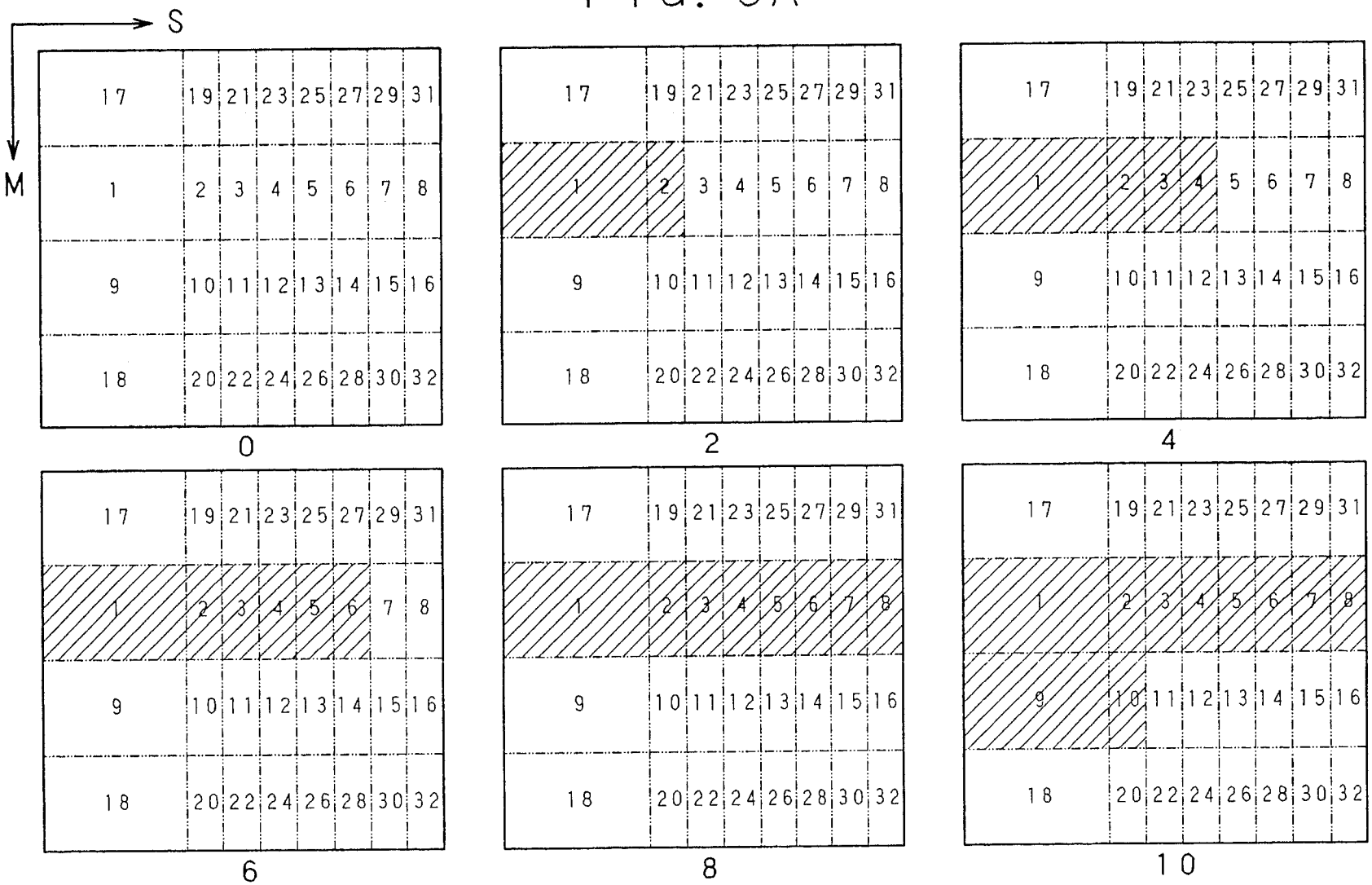
FIGS. 3(*a*) to 3(*c*) are diagrams explaining a relationship between a tonal level and an ink dot pattern.
Figure 3B:
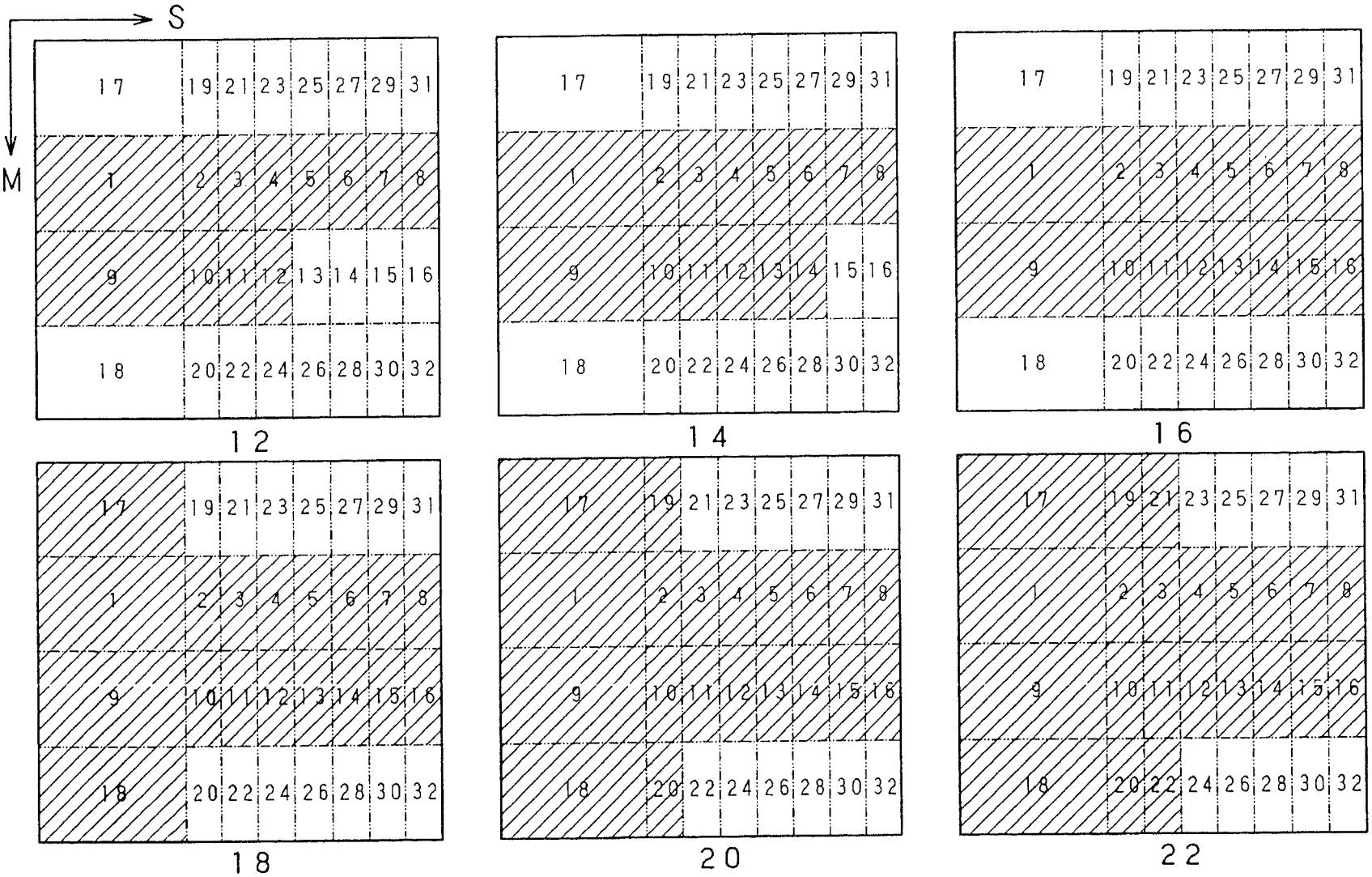
Figure 3C:
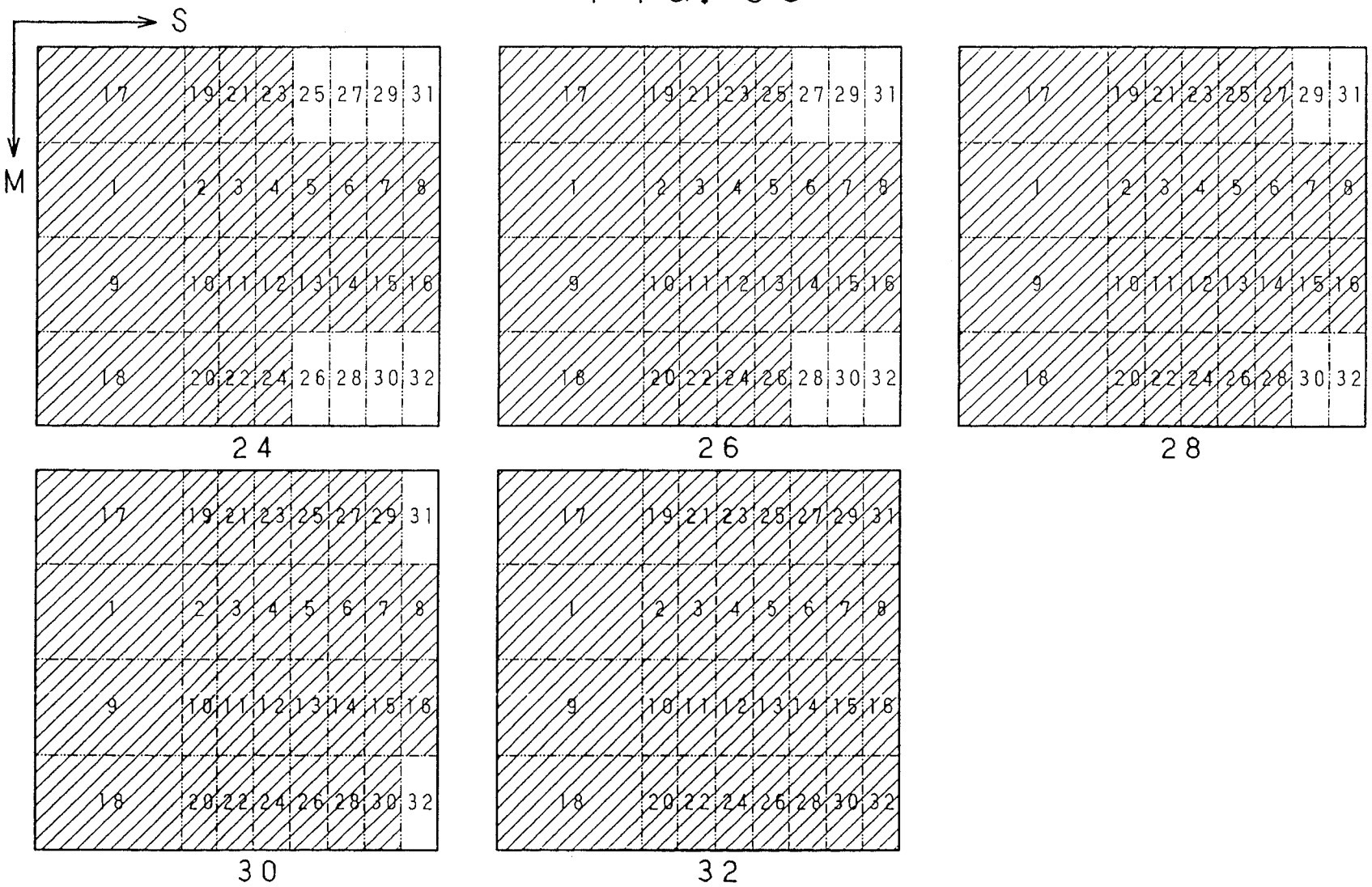

FIGS. 3(*a*)–3(*c*) show relationships between a pixel ink dot pattern and a pixel tonal level. One pixel is constituted by 4×8 cells and is recorded by a set of four heating elements. The number in each cell indicates the tonal level. For example, the image data with a tonal level of "10" is given the numbers from "1" to "10". Micro ink dots indicated by the hatching are recorded in cells. Ten micro dots collectively form an ink dot of one pixel.

As can be understood with ease from the ink dot patterns of the tonal levels of "0" and "2", in the case of the tonal level of "1", the heating element 10*b*1 is driven only for one time and an elemental micro dot having an area of A×B is recorded on the second subsidiary micro line at the first main micro line. Namely, an elemental micro dot is recorded in the first cell on the second subsidiary micro line.

For the tonal levels of "2" to "8", the second and following main micro lines are sequentially subjected to recording, increasing the number of micro dots each having an area of A×L one by one in the subsidiary scan direction S. For the tonal levels of "9" to "16", the heating element 10*c*1 as well as the heating element 10*b*1 is driven, and micro dots are sequentially recorded on the second and third of the subsidiary micro lines and by starting from the first main micro line. For the tonal levels of "18" or larger, all the heating elements 10*a*1 to 10*d*1 are driven. Micro dots are sequentially recorded on the second and third of the subsidiary micro lines and by starting from the first main micro line, and recorded alternately on the first and fourth of the subsidiary micro lines from the first main micro line in accordance with the tonal level.

Figure 4:
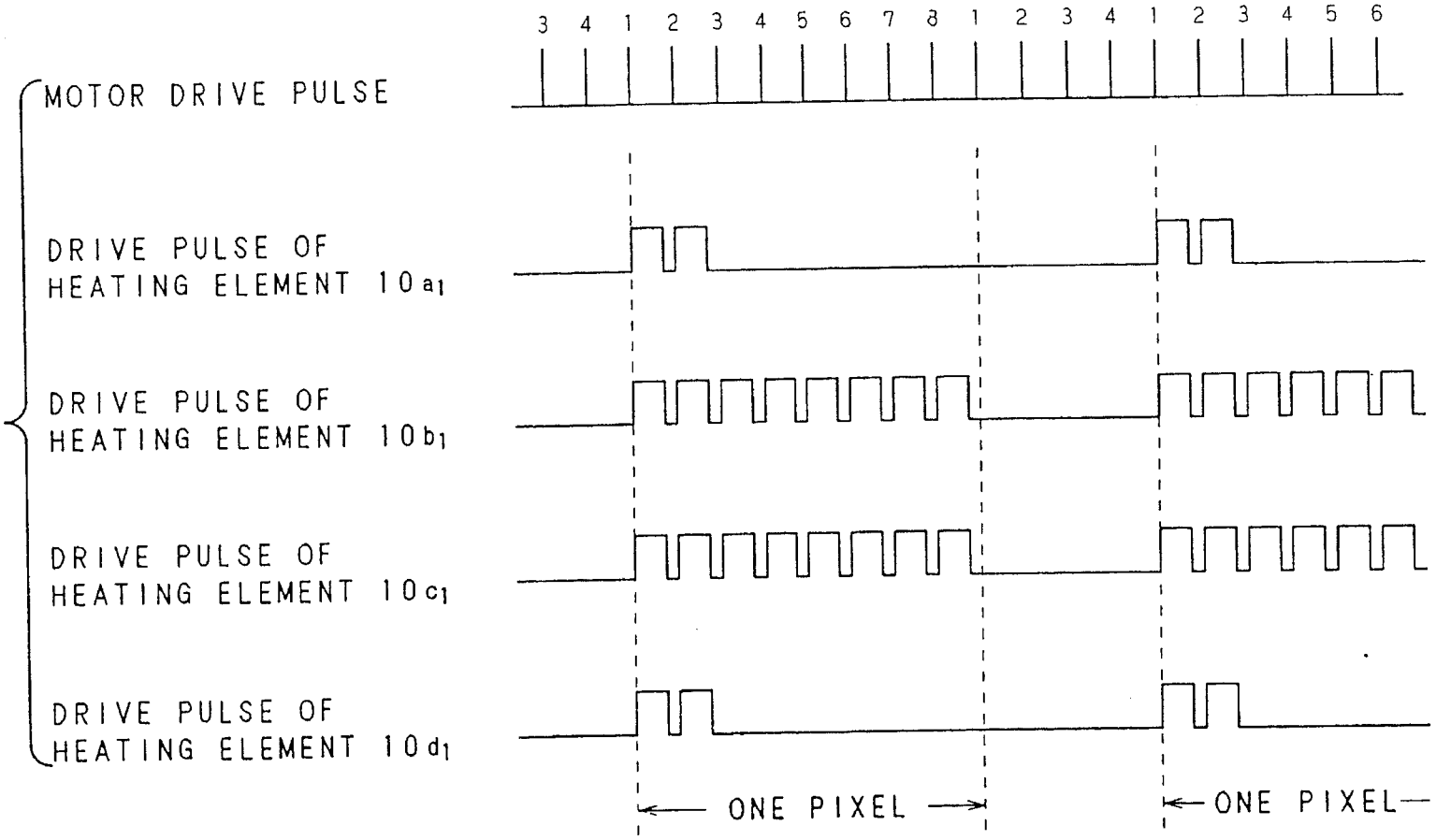
FIG. 4 is a timing chart of recording an image.

As shown in FIG. 4, in the case of the tonal level of "20", for example, first the heating elements 10*a*1 to 10*d*1 are driven by drive pulses to record elemental micro dots. As a result, an ink dot having an area of 4A×B is recorded by the four heating elements 10*a*1 to 10*d*1. Each drive pulse is generated for drive data of "1", and is not generated for drive data of "0". After the thermal head 10 is moved by one step in the subsidiary scan direction S, all the heating elements 10*a*1 to 10*d*1 are driven, and an ink dot having an area of 4A×L is recorded continuously following the ink dot having the area of 4A×B. Next, after the thermal head 10 is moved by one step, only the central heating elements 10*b*1 and 10*c*1 are driven to record an ink dot having an area of 2A×L. Similarly, the heating elements 10*b*1 and 10*c*1 are thereafter driven until the last eighth step to record an ink dot having an area of 2A×L at each step. Thereafter, the thermal head 10 is moved by four steps in the subsidiary scan direction S. In the course of this blank section of four steps, the virtual drive data of "0" is supplied so that no drive pulse is supplied to the heating elements 10*a*1 to 10*d*1, leaving the heating elements in a cooling state.

Figure 5:
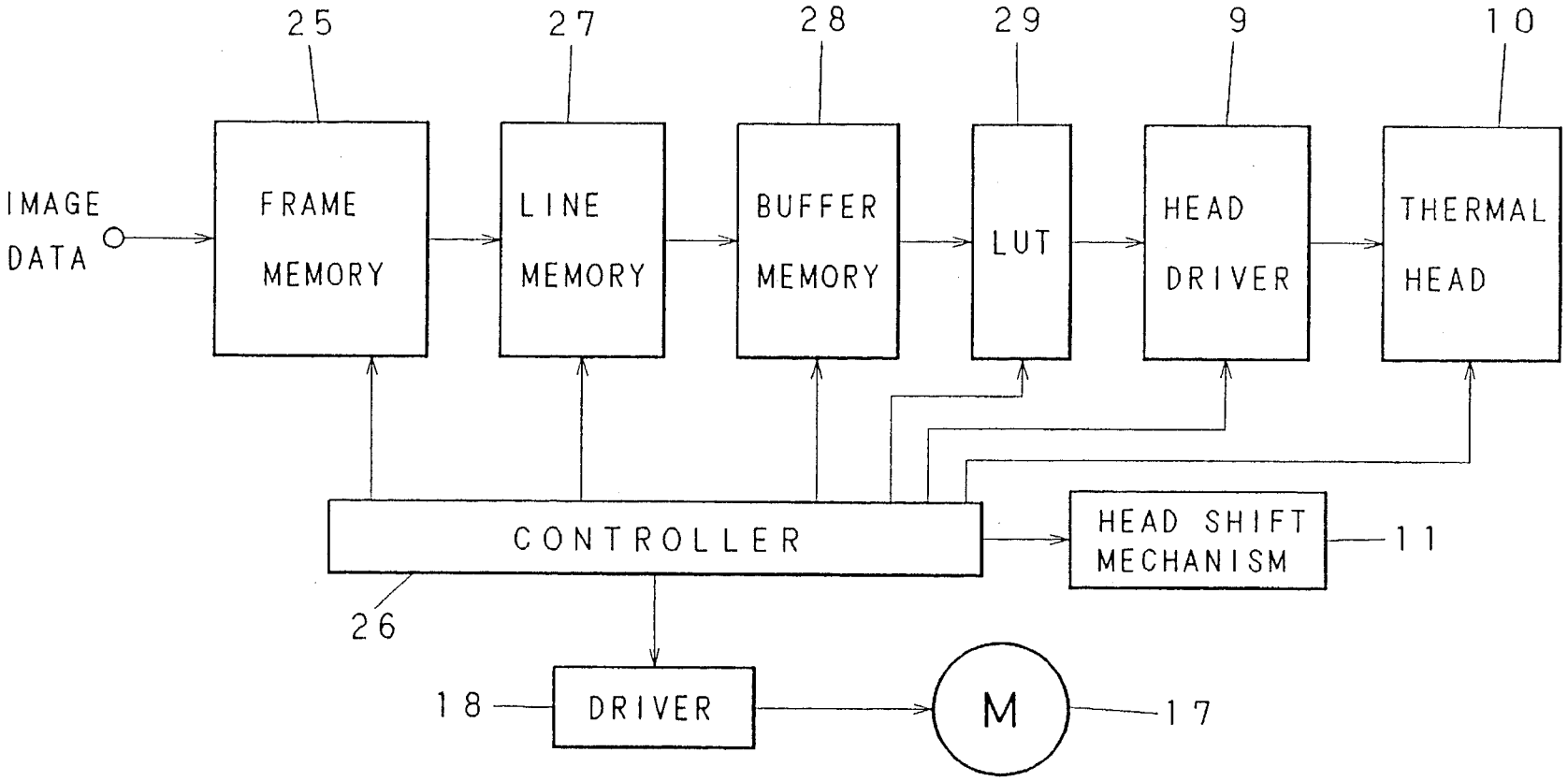
FIG. 5 is a block diagram showing an example of a head driver unit.

FIG. 5 shows an example of a head drive unit. Image data representative of a tonal level is inputted from a video tape recorder or a scanner. This image data is written in a frame memory 25. In recording an image, a controller 26 reads image data of one column, i.e., image data of thirty six pixels disposed in the main scan direction, from the frame memory 25, and writes the image data into a line memory 27. The image data of one column is transferred from the line memory 27 to a buffer memory 28.

Image data is converted at a LUT (look-up table) 29 into drive data for recording an ink dot pattern such as shown in FIG. 4. Specifically, since one pixel is recorded by four heating elements, one image data is converted into four series of drive data, each series being constituted by eight bits. Drive data of "1" is assigned for recording a micro dot, and drive data of "0" is assigned not to record any micro dot.

In the case of the tonal level of "20", for example, drive data of "11000000" is serially outputted and converted by a head driver 9 into two drive pulses. Drive data of "11111111" is assigned to the heating elements 10*b*1 and 10*c*1, and converted into eight drive pulses. Drive data of "11000000" is assigned to the heating element 10*d*1.

Next, the record sequence of the serial printer will be described. First, image data of an image to be printed is written in the frame memory 25. Upon operation of a print start key (not shown), the platen roller 13 and feed roller 14 rotate in the arrow direction to feed the top of a record area of the recording sheet 12 to the position of the thermal head 10. The thermal head 10 and ribbon cassette 16 are moved to the initial position at the left side end.

Image data of thirty-six pixels in one column disposed in the main scan direction is read from the frame memory 25 and written in the line memory 27. The image data of one column is transferred to the buffer memory 28. Each image data is converted by LUT 29 into four series of drive data corresponding to the tonal level, and the drive data is converted into drive pulses by the head driver 9.

While the thermal head 10 and ribbon cassette 16 are moved to the right in the subsidiary scan direction, the thermal head 10 pushes and heats the ink ribbon 15 from the back thereof to transfer melted ink to the recording sheet 12. In this manner, as shown in FIG. 4, ink dot patterns corresponding to tonal levels are recorded. After the pixels in one column are recorded, the thermal head 10 and ribbon cassette 16 are moved by five steps in the subsidiary scan direction S and are faced with the first main micro line of the next pixels. In course of this blank section of four steps, the thermal head 10 is driven by the virtual drive data 24 shown in FIG. 2. This virtual drive data 24 has each bit of "0" so that the heating elements are not driven.

After the thermal head 10 moves to the right end of the recording sheet 12 and one line is recorded, heating and pressing the ink ribbon 15 is stopped, and the thermal head 10 and ribbon cassette 16 are moved to the left to take the initial position. In the course of this return motion, the platen roller 13 and feed roller 14 rotate to feed the recording paper 12 and the next line is moved to the position of the thermal head 10. This feed amount is 144×A. Thereafter, the above operations are repeated to record an image on the recording paper 12 one line after another. After recording, the platen roller 13 and feed roller 14 continuously rotate in the arrow direction to eject the recording paper 12.

In the embodiment described above, each time one pixel is recorded, the thermal head is moved without powering the heating elements until the recording of the next pixel starts. Therefore, during this period, the thermal head enters completely a cooling state. However, there is a fear of insufficiently melted or softened ink when the next pixel is recorded, because of a low tonal level of the preceding pixel and the thermal head cooled too much. In such a case, each heating element may be driven to warm up or preheat the thermal head to such an extent that ink is not transferred or a small amount of ink is transferred. If the thermal head is warmed up, it is advantageous in that a smooth tonal level can be obtained without unevenness of texture which would be likely to occur at a low tonal level.

Figure 6:
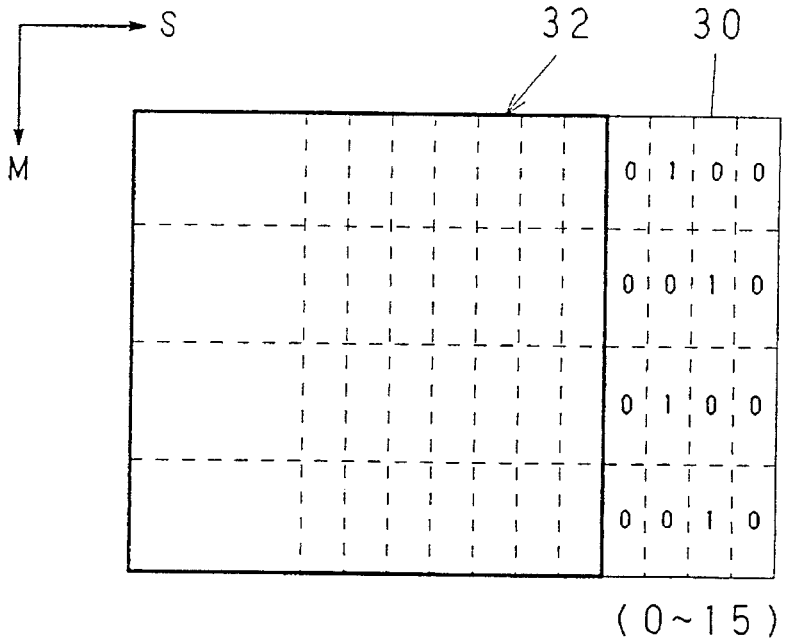
FIGS. 6 to 10 are diagrams explaining other examples of virtual drive data.

In an embodiment shown in FIG. 6, virtual drive data 30 is used at the blank section after recording a pixel 32 of a low tonal level from "0" to "15". This virtual drive data has "1" at the second step of the first and third of the subsidiary micro lines and at the third step of the second and fourth of the subsidiary micro lines. Powering the heating elements in the course of the blank section in the above manner is used for preheating the heating elements, and little ink is transferred, because of a sufficient cooling period. In course of the blank section after recording a pixel having a tonal level from "16" to "32", the virtual drive data with all "0s" shown in FIG. 2 is used.

Figure 7:
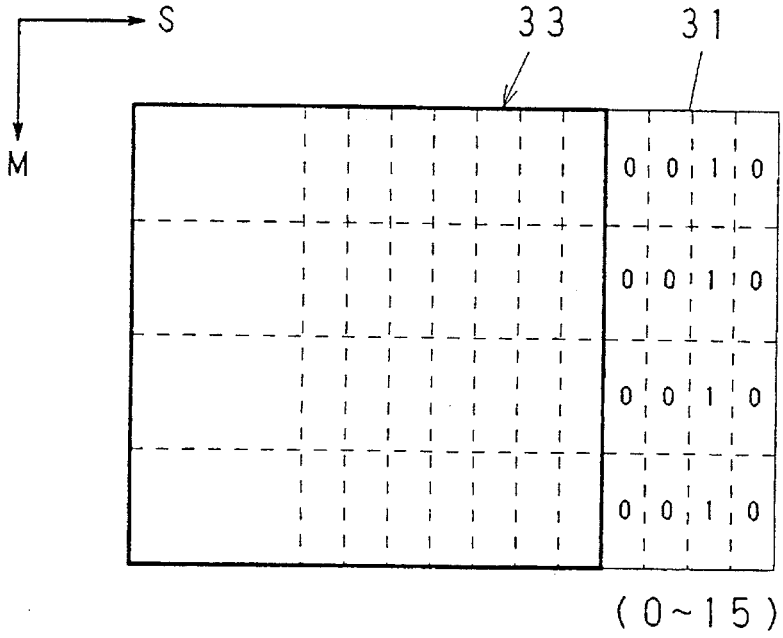

In an embodiment shown in FIG. 7, virtual drive data 31 is used after recording a pixel 33 having a tonal level from "0" to "15". This virtual drive data is also used for preheating the heating elements. In course of the blank section after recording a pixel having a tonal level from "16" to "32", the virtual drive data shown in FIG. 2 is used.

Figure 8:
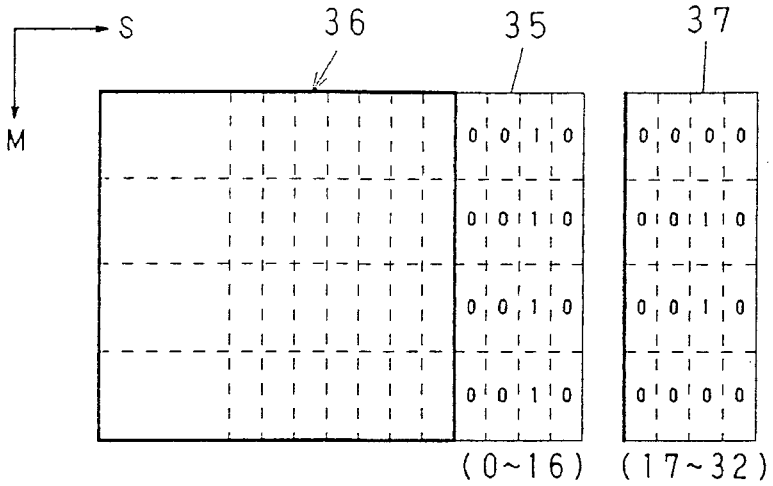

In an embodiment shown in FIG. 8, virtual drive data 35 is used if the tonal level of a preceding pixel 36 is from "0"

to "16", and virtual drive data 37 is used for a tonal level from "17" to "32". Central two heating elements are preheated even at the tonal level from "17" to "32" so as not to fully cool them. This arrangement is suitable for an ink dot pattern such as shown in FIG. 3 wherein central heating elements are frequently driven.

Figure 9:
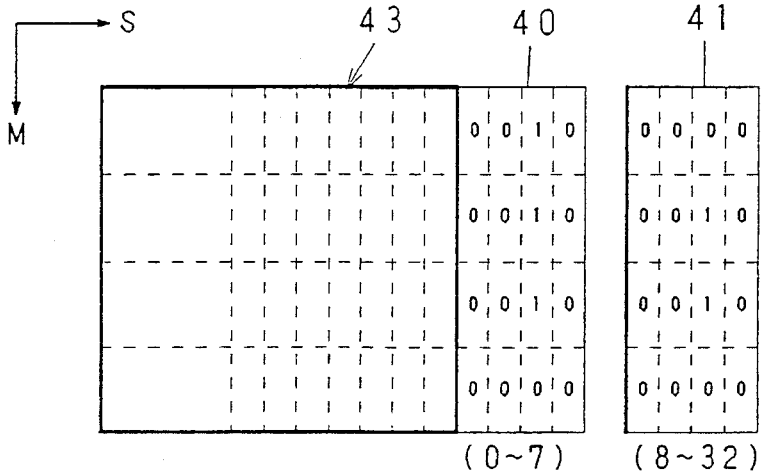

In an embodiment shown in FIG. 9, virtual drive data 40 is used if the tonal level of a preceding pixel 43 has a tonal level from "0" to "7", and virtual drive data 41 is used for a tonal level from "8" to "32". With these virtual drive data 40 and 41, the heating element of the subsidiary micro line at the fourth row having a least use frequency is not preheated.

Figure 10:
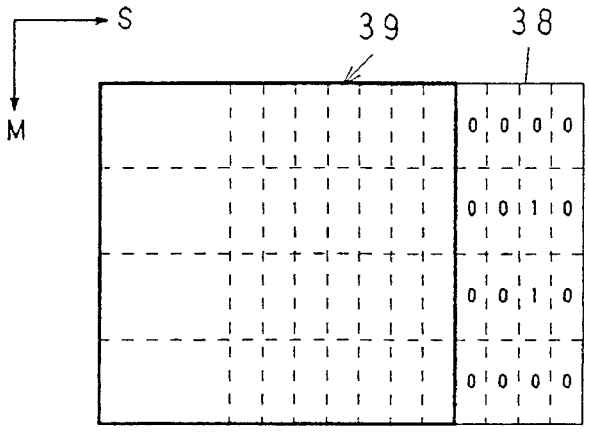

In an embodiment shown in FIG. 10, irrespective of the tonal level of a preceding pixel 39, common virtual drive data 38 is used. With this virtual drive data, only the central two heating elements are always preheated.

The above-described embodiments assume monochrome recording. The invention is also applicable to color recording. In this case, a color ink ribbon is used which is formed, as is well known, with cyan, magenta and yellow, and if necessary, black ink areas at a constant pitch, and each color is line-sequentially recorded.

The invention is also applicable to monochrome thermal direct printing and color thermal direct printing. In the color thermal direct printing, a color thermosensitive recording paper is used which is formed with a yellow thermosensitive coloring layer, a magenta thermosensitive coloring layer, and a cyan thermosensitive coloring layer sequentially laid one upon another. In the above embodiments, the number of tonal levels is assumed to be "33". The number of tonal levels may be "32" including "1" to "32" because a half tone image has no tonal level of "0", or may be "64" or "256".

Although the present invention has been described with reference to the preferred embodiments shown in the drawings, the invention should not be limited by the embodiments but, to the contrary, various modifications, changes, combinations and the like of the present invention which can be effected without departing from the spirit and scope of the appended claims should be included therein.

We claim:

1. A serial thermal printing method of recording a half tone image on a recording paper by a thermal head by changing an area of ink dots corresponding to a pixel of input image data of the half tone image, the thermal head having a plurality of heating elements disposed in a main scan direction, each of the heating elements having a length A in the main scan direction and a length B in a subsidiary scan direction, perpendicular to the main scan direction, and recording a subsidiary micro line of the length A in the main scan direction and extending in the subsidiary scan direction by a plurality of main micro lines, the thermal head being moved in the subsidiary scan direction for recording of each line of the half tone image and the recording paper being moved in the main scan direction to record subsequent lines, said serial thermal printing method comprising the steps of:

forming each pixel of the half tone image from N of said subsidiary micro lines, recorded by N adjacent heating elements, and from M of said plurality of main micro lines extending in the main scan direction, each main micro line corresponding to at least one movement of said thermal head in the subsidiary scan direction;

setting the width of a first of said M main micro lines equal to said length B and the width of each of the second to Mth of said main micro lines equal to a width L, smaller than said length B;

selectively driving said heating elements in accordance with drive data, generated in association with image data corresponding to each pixel of the half tone image, each time each of said heating elements moves by a distance equal to said width L in the subsidiary scan direction for each said pixel, to record each of a plurality of ink micro dots such that the area of recorded ink micro dots increasingly changes from the first main micro line toward the Mth main micro line; and moving said thermal head to record an (n+1)th pixel, after recording of the Mth main micro line of an nth pixel consecutive in the subsidiary scan direction, without driving each of said heating elements in accordance with the drive data until each of said heating elements reaches a first main micro line of said (n+1)th pixel.

2. A serial thermal printing method according to claim 1, wherein said length B is an integer multiple of said width L.

3. A serial thermal printing method according to claim 1, wherein said thermal head heats an ink ribbon superposed upon said recording paper and transfers ink from said ink ribbon to said recording paper.

4. A serial thermal printing method according to claim 3, wherein at least one main micro line is located between said nth pixel and said (n+1)th pixel.

5. A serial thermal printing method of recording a half tone image on a recording paper by a thermal head by changing an area of ink dots corresponding to a pixel of input image data of the half tone image, the thermal head having a plurality of heating elements disposed in a main scan direction, each of the heating elements having a length A in a main scan direction and a length B in a subsidiary scan direction, perpendicular to the main scan direction, and recording a subsidiary micro line of the length A in the main scanning direction and extending in the subsidiary scan direction by a plurality of main micro lines, the thermal head being moved in the subsidiary scan direction for recording of each line of the half tone image and the recording paper being moved in the main scan direction to record subsequent lines, said serial thermal printing method comprising the steps of:

forming each pixel of the half tone image from N of said subsidiary micro lines, recorded by N adjacent heating elements, and from M of said plurality of main micro lines extending in the main scan direction, each main micro line corresponding to at least one movement of said thermal head in the subsidiary scan direction;

setting the width of a first of said M main micro lines equal to said length B and the width of each of the second to Mth of said main micro lines equal to a width L, smaller than said length B;

selectively driving said heating elements in accordance with drive data, generated in association with image data corresponding to each pixel of the half tone image, each time each of said heating elements moves by a distance equal to said width L in the subsidiary scan direction for each said pixel, to record each of a plurality of micro ink dots such that the area of recorded micro ink dots increasingly changes from the first main micro line toward the Mth main micro line; and driving said heating elements in accordance with virtual drive data, after recording of the Mth main micro line of an nth pixel consecutive in the subsidiary scan direction and before selectively driving said heating elements, to record a first main micro line of said (n+1)th pixel in association with image data of the half tone image, said virtual drive data being determined irrespective of said half tone image data of the (n+1)th pixel.

6. A serial thermal printing method according to claim 5, wherein said length B is an integer multiple of said width L.

7. A serial thermal printing method according to claim 5, wherein said thermal head heats an ink ribbon superposed upon said recording paper and transfers ink from said ink ribbon to said recording paper.

8. A serial thermal printing method according to claim 7, wherein at least one main micro line is located between said nth pixel and said (n+1)th pixel.

9. A serial thermal printing method according to claim 7, wherein said virtual drive data is drive data insufficient to fully heat each of said heating elements.

10. A serial thermal printing method according to claim 7, wherein said virtual drive data is determined in accordance with a half tone image state of said nth pixel, for selectively driving and preheating said heating elements prior to recording the (n+1)th pixel.

11. The serial thermal printing method of claim 10, wherein the virtual drive data is varied between a first set of virtual drive data and a second set of virtual drive data.

12. The serial thermal printing method of claim 10, wherein the virtual drive data of at least one of the plurality of heating elements remains constant irrespective of the half tone image state of the nth pixel, and the virtual drive data of at least one of the plurality of heating elements varies dependent upon the half tone image state of the nth pixel.

13. The serial thermal printing method of claim 7, wherein the virtual drive data is predetermined irrespective of the half tone image state of the nth pixel.

14. A serial thermal printing method for printing an image on recording paper, comprising the steps of:

(a) establishing a predetermined number of heating elements of a thermal head arranged in a first direction, to print a pixel of input image data, each heating element being of an equal first predetermined length in the first direction and an equal second predetermined length in a second direction, perpendicular to the first direction;

(b) selectively driving the established predetermined number of heating elements in accordance with the input image data;

(c) moving the thermal head in the second direction and forming a plurality of ink dots on the recording paper based upon the selectively driven heating elements of step (b), each of the predetermined number of heating elements forming a line of ink dots of a pixel, the predetermined number of heating elements being selectively driven in accordance with the image data for a predetermined number of intervals for generation of ink dots of a pixel, a first interval corresponding to at least two step movements of the thermal heat in the second direction and each of the remaining intervals corresponding to one step movement;

(d) selectively driving the predetermined number of heating elements in accordance with virtual drive data subsequent to being driven in accordance with the image data for the predetermined number of intervals, to allow for the predetermined number of heating elements to cool down.

15. The method of claim 14, wherein the virtual drive data is predetermined irrespective of the input image data.

16. The method of claim 14, wherein the virtual drive data is predetermined based upon image data of a previously formed pixel.

17. The method of claim 16, wherein the image printed is a half tone image.

18. The method of claim 17, wherein the virtual drive data of at least one of the predetermined number of heating elements remains constant irrespective of the half tone image data of a previously formed pixel, and the virtual drive data of at least one of the predetermined number of heating elements varies dependent upon a half tone image data of a previously formed pixel.

* * * * *